US009539584B2

(12) United States Patent
Oki et al.

(10) Patent No.: US 9,539,584 B2
(45) Date of Patent: Jan. 10, 2017

(54) MAGNETIC SEPARATOR

(71) Applicant: NATIONAL INSTITUTE OF ADVANCED INDUSTRIAL SCIENCE AND TECHNOLOGY, Tokyo (JP)

(72) Inventors: Tatsuya Oki, Ibaraki (JP); Yoko Umemiya, Ibaraki (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 0 days.

(21) Appl. No.: 14/387,455

(22) PCT Filed: Feb. 7, 2013

(86) PCT No.: PCT/JP2013/052809
§ 371 (c)(1),
(2) Date: Dec. 12, 2014

(87) PCT Pub. No.: WO2013/145872
PCT Pub. Date: Oct. 3, 2013

(65) Prior Publication Data

US 2015/0101965 A1 Apr. 16, 2015

(30) Foreign Application Priority Data

Mar. 28, 2012 (JP) ..... 2012-073902

(51) Int. Cl.
*B03C 1/18* (2006.01)
*B03C 1/22* (2006.01)
*B03C 1/16* (2006.01)

(52) U.S. Cl.
CPC . *B03C 1/22* (2013.01); *B03C 1/18* (2013.01); *B03C 1/16* (2013.01); *B03C 2201/20* (2013.01)

(58) Field of Classification Search
CPC .... B03C 1/22; B03C 2201/20; B03C 2201/22; B03C 1/16; B03C 1/18; B03C 1/30; C22B 1/005; C22B 34/24
See application file for complete search history.

(56) References Cited

U.S. PATENT DOCUMENTS 581,032 A * 4/1897 Pike ..... B07B 4/08 209/181
2,591,121 A * 4/1952 Blind ..... B03C 1/20 209/218

(Continued)

FOREIGN PATENT DOCUMENTS

JP 60-251943 A 12/1985
JP 05-146708 A 6/1993

(Continued)

OTHER PUBLICATIONS

Derwent Abstract 2011-M85172 of KR 1069296 B1, Inventor: Ahn et al., Published Oct. 5, 2011.*

(Continued)

*Primary Examiner* — Joseph C Rodriguez
(74) *Attorney, Agent, or Firm* — Pergament & Cepeda LLP; Milagros A. Cepeda; Edward D. Pergament

(57) ABSTRACT

A weak magnetic force magnetic separator, including: a belt conveyor conveying separation target particles; and a suspended magnet unit provided at a distance above the belt conveyor and configured to magnetically attract, with a uniform, weak magnetic force, the separation target particles conveyed over a belt. With a length of the magnet unit in its longer direction being greater than a belt width of the belt, and with the magnet unit placed such that its longer direction is aligned with the belt width direction and its both ends overhang the belt width, and such that a distance from the surface of the belt is constant across its longer direction, magnetic flux density variations in the belt width direction (Continued)

over the belt surface facing the magnet unit are 10% or less within a weak magnetic force range of from over 0 to 700 gauss.

2 Claims, 2 Drawing Sheets

(56) References Cited

U.S. PATENT DOCUMENTS 2,591,122 A * 4/1952 Blind ..... B03C 1/20 209/223.1
2,724,504 A * 11/1955 Blind ..... B03C 1/20 209/223.1
2,826,302 A * 3/1958 Scott ..... B03C 1/22 209/218
3,935,947 A * 2/1976 Barrett ..... B03C 1/22 198/690.1
4,273,646 A * 6/1981 Spodig ..... B03C 1/22 209/223.1
4,451,360 A * 5/1984 Salmi ..... B03C 1/10 209/215
6,364,117 B1 4/2002 Takano et al.
7,090,080 B2 * 8/2006 LaVeine ..... B03B 9/061 209/223.1
7,168,568 B2 * 1/2007 Wise ..... B03C 1/04 209/225
8,807,344 B2 * 8/2014 Keaton ..... B03C 1/0332 209/214
8,852,317 B2 * 10/2014 Yoshida ..... C22B 7/006 148/514
2007/0148066 A1 * 6/2007 Horta ..... C01G 23/047 423/80
2008/0148902 A1 * 6/2008 Gillis ..... C22B 7/005 75/10.67
2008/0286181 A1 * 11/2008 Freitas ..... C01G 23/047 423/80
2011/0056874 A1 * 3/2011 Kojima ..... B07C 5/368 209/552
2013/0336858 A1 * 12/2013 Aoki ..... C22B 1/005 423/68
2015/0231669 A1 * 8/2015 Oki ..... B07B 4/02 209/139.1

FOREIGN PATENT DOCUMENTS

JP 07-100436 A 4/1995
JP 08-001040 A 1/1996
JP 08-001041 A 1/1996
JP 63-6056 U 1/1998
JP 2000-037664 A 2/2000
JP 2000-334328 A 12/2000
JP 2001-009380 A 1/2001
JP 2003-300210 A 10/2003
JP 3508279 B2 3/2004
JP 2005-118685 A 5/2005
JP 2006-075793 A 3/2006
JP 4001830 B2 10/2007
JP 2010-214352 A 9/2010

OTHER PUBLICATIONS

International Search Report dated Apr. 23, 2013, for International Patent Application No. PCT/JP2013/052809.
Notice of Reason for Rejection mailed by the Japanese Patent Office on Jul. 28, 2015, for corresponding Patent Application No. JP 2014-507487. (With English Translation).

* cited by examiner

MAGNETIC SEPARATOR

This application is a National Phase application under 35 U.S.C. 371 of International Application No. PCT/JP2013/052809, filed on Feb. 7, 2013, which claims priority to Japanese provisional application No. 2012-073902, filed on Mar. 28, 2012; all of which are hereby incorporated by reference in their entireties.

TECHNICAL FIELD

The present invention relates to a magnetic separator that is for magnetically separating particles and suitable in a recycling industry field and a food/material field in which particle separation is performed, and particularly to a weak magnetic force magnetic separator that magnetically recovers only ferromagnetic particles that can be magnetized with a weak magnetic force from among particles conveyed by a belt conveyor, using a suspended magnet unit suspended above the belt conveyor.

BACKGROUND ART

Magnetic separators are one of the commonest particle separators that are used widely. They use a method of magnetically attracting and trapping iron scraps and the like with a magnet suspended from above, a magnet stored in a pulley of a conveyor, or magnets disposed on both sides of a flow path of particles, to thereby separate them from nonmagnetic particles. As the magnet, not only a permanent magnet, but also an electromagnet and a superconducting magnet may be used. In another method, a matrix made of iron thin lines is disposed between magnets in order for a magnetization gradient to be increased. Any of the methods are means for magnetically trapping particles and microparticles having a weak magnetic property. As can be understood from above, the conventional magnetic separators aim for a technical goal of magnetically trapping as many particles as possible with a strong magnetic attractive force (a magnetic flux density or a magnetization gradient). There are few separators that are characterized by a weak magnetization property. However, PTL 1, for example, expressly describes an embodiment of such a weak magnetization property by means of reducing the sensitivity (a magnetic force) of a magnetic separator, but does not describe a specific apparatus and method. PTL 2 describes magnetic attraction of only ferromagnetic bodies with, like the present invention, a suspended magnetic separator that is placed at a distance from particles on a conveyor, but does not describe detailed conditions and performance thereof.

Meanwhile, shape separators include sensing sorters that distinguish the targets based on images monitored with a camera, mechanical separators utilizing rolling over an inclined surface, and gas stream separators using a shape as one of the separation factors. Mechanical shape separators include a centrifugal type, a vibration type, an inclined type, etc. Examples of inclined belt particle separators using a conveyor belt are described in PTLs 3 to 5.

Furthermore, there is an inclined belt separator combined with a magnetic separation function, which stores a magnet on the lower surface of the belt (see PTL 6).

CITATION LIST

Patent Literature

PTL 1: Japanese Patent Application Laid-Open (JP-A) No. 2006-75793

PTL 2: JP-A No. 05-146708
PTL 3: JP-A No. 2001-9380
PTL 4: Japanese Patent (JP-B) No. 3508279
PTL 5: JP-B No. 4001830
PTL 6: JP-A No. 2005-118685
PTL 7: JP-A No. 2010-214352

SUMMARY OF INVENTION

Technical Problem

Previously, the present inventors have filed a patent application for a tantalum capacitor recycling method of PTL 7. PTL 7 describes an invention of a tantalum capacitor recycling method including: a primary concentration step of stripping and recovering from used printed circuit boards, elements mounted on the boards, and separating the stripped recovered elements through a sieve, to thereby recover particles that are within the same dimension range as that of tantalum capacitors; a secondary concentration step of recovering particles that are within the same specific gravity range as that of tantalum capacitors from the primarily concentrated products by specific gravity separation; and a third concentration step of recovering non-magnetically attractable particles as highly concentrated tantalum capacitor products from the secondarily concentrated products by weak magnetic separation. In the third concentration step, a weak magnetization magnetic separator for performing weak magnetic separation is necessary.

For example, kind-by-kind separation of electronic elements stripped from printed circuit boards with a magnetic separator will be considered. When a magnetic separator such as a rare-earth natural magnet, an electromagnet, and a superconducting magnet performs separation with its high magnetic attractive force, it reacts even to nickel coating and trace iron to get most of the elements magnetically attracted, and cannot realize kind-by-kind separation of the elements. A magnetic separator of a common type (with a magnetic flux density of 0.1 T or greater) recovers elements by magnetically attracting elements rich in iron, and lead wires connected to elements. However, when this method is used to magnetically separate, for example, tantalum capacitors that may result in being stripped with a lead wire or with no lead wire when stripped from printed circuit boards, the elements of the same kind may be separated into magnetically attractable products and non-magnetically attractable products.

Meanwhile, among electronic elements stripped from printed circuit boards, it may be possible to extract, for example, cylindrical elements such as aluminum electrolytic capacitors from the mixed elements, by letting them roll down an inclined surface. However, with a conventional inclined belt shape separator, unless the cylindrical shapes are supplied onto the belt such that their side surface turns to the inclination direction, they remain on the belt as well as block-rectangular particles. Furthermore, small block-rectangular elements may roll down the inclination when a vibration is applied. Therefore, precise shape separation is impossible.

An object of the present invention is to provide an apparatus for magnetically recovering only ferromagnetic particles. Another object of the present invention is to provide an apparatus for realizing also precise shape separation of cylindrical particles within a compact apparatus in which a magnetic separation conveyor is inclined.

Solution to Problem

To achieve the objects described above, a weak magnetic force magnetic separator of the present invention includes:

a belt conveyor configured to convey separation target particles; and a suspended magnet unit provided above the belt conveyor at a distance from the belt conveyor, wherein the magnet unit magnetically recovers ferromagnetic bodies and refuses to magnetically recover weakly magnetic bodies by magnetically attracting, with a uniform, weak magnetic force, the separation target particles conveyed over a belt of the belt conveyor, wherein with a length of the magnet unit in its longer direction being greater than a belt width of the belt, and with the magnet unit placed such that its longer direction is aligned with a direction of the belt width and its both ends overhang the belt width, and such that a distance from a surface of the belt is constant across its longer direction, variations in magnetic flux density in the direction of the belt width in a surface region of the belt facing the magnet unit are 10% or less within a weak magnetic force range of from over 0 gauss to 700 gauss.

The weak magnetic force magnetic separator of the present invention separates the separation target particles based on shapes thereof into those having a shape that rolls down an inclined surface by gravity and those having a shape that does not roll down the inclined surface by gravity, by inclining the belt toward a direction that is at a right angle from a moving direction of the belt.

The weak magnetic force magnetic separator of the present invention further includes: at least one swing pin-gate above the belt of the belt conveyor, wherein the separation target particles conveyed over the belt are prompted to change postures over the belt upon contacting a pin of the pin-gate.

The weak magnetic force magnetic separator of the present invention is characterized in that the separation target particles are secondarily concentrated products that are obtained by performing primary concentration to recover particles that are in the same dimension range as that of tantalum capacitors from elements stripped and recovered from used printed circuit boards, and then performing secondary concentration according to specific gravity separation to recover particles that are in the same specific gravity range as that of the tantalum capacitors from the particles recovered by the primary concentration, and that the weak magnetic force magnetic separator obtains from the separation target particles, particles that are discharged from the belt conveyor without being magnetically recovered, as highly concentrated tantalum capacitor products.

Advantageous Effects of Invention

The weak magnetic force magnetic separator of the present invention employs a suspended magnet unit, instead of a roll type such as a magnetic pulley that tends to produce magnetic force variations over the belt. And without using both ends of the suspended magnet unit that tend to produce magnetic force variations, the weak magnetic force magnetic separator magnetically attracts particles conveyed over the belt with a uniform, weak magnetic force with a roughly central portion of the magnet unit except for the both ends of the magnet unit that has a dimension greater than the belt width, to thereby make it possible to magnetically recover all ferromagnetic bodies and recover none of weakly magnetic bodies at all. The present invention can cover a very low magnetic flux density range of roughly from over 0 gauss to 700 gauss (from over 0 tesla [T] to 0.07 tesla [T]). Further, if necessary, it is possible to make magnetic flux density adjustment within the very low magnetic flux density range, by providing the suspended magnet unit with a vertical micro-motion device to provide a function of moving upward and downward within a range of roughly from 2 cm to 50 cm from the surface of the belt by a millimeter unit.

In one embodiment of the present invention, a thin pin obstacle is placed on the belt in the middle of conveyance over the conveyor. Therefore, upon contacting the obstacle, cylindrical particles change postures and immediately roll down an inclined surface as long as their side surface has turned to the inclination direction during the process of changing postures. This promotes shape separation and improves the precision of shape separation. Further, when the pin is a swing pin-gate, the pin is not blocked by getting the particles accumulated, and no excessive load is imposed on both of the pin and the separation target particles.

DESCRIPTION OF EMBODIMENTS

Examples

The present invention is a weak magnetic force magnetic separator, including: a belt conveyor configured to convey separation target particles; and a suspended magnet unit provided above the belt conveyor at a distance from the belt conveyor, wherein the magnet unit magnetically recovers all ferromagnetic bodies and magnetically recovers none of weakly magnetic bodies by magnetically attracting, with a uniform, weak magnetic force, the separation target particles conveyed over a belt, and wherein with a length of the suspended magnet unit in its longer direction being greater than a belt width, and with the magnet unit placed such that its longer direction is aligned with a direction of the belt width and its both ends overhang the belt width, and such that the distance from a surface of the belt is constant across its longer direction, variations in magnetic flux density in the direction of the belt width in a surface region of the belt facing the magnet unit are 10% or less within a weak magnetic force range of from over 0 gauss to 700 gauss. The present invention employs a suspended magnet unit instead of a roll type such as a magnet pulley that tends to produce magnetic force variations over the belt, and does not use both ends of the magnet unit that tend to produce magnetic force variations. Therefore, the present invention can realize a magnetic separator that magnetically recovers all ferromagnetic bodies and magnetically recovers none of weakly magnetic bodies by magnetically attracting, with a uniform, weak magnetic force, separation target particles conveyed over a belt.

Figure 1:
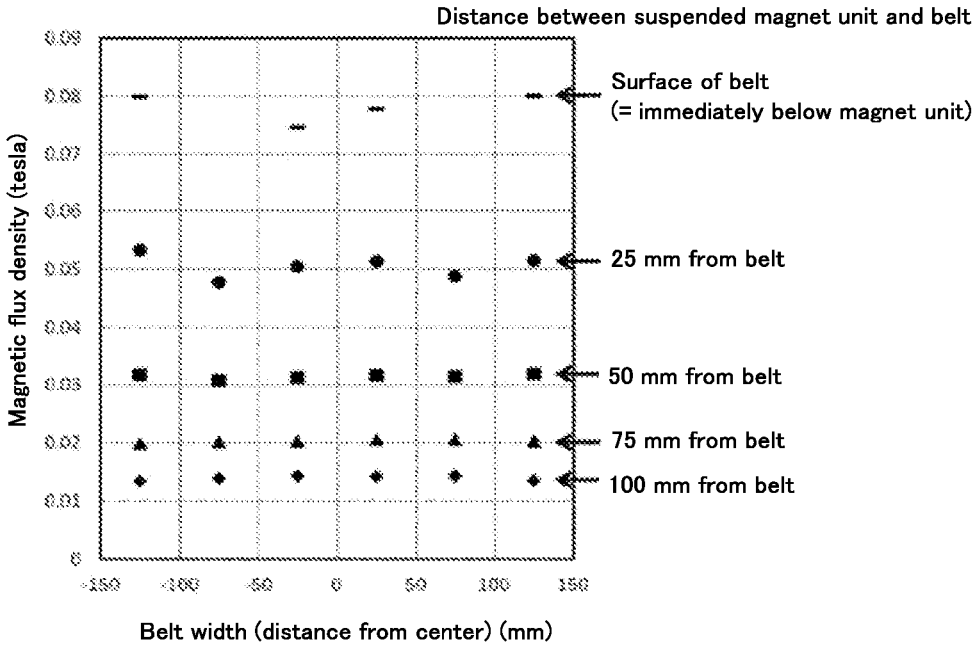
FIG. 1 is a diagram showing a magnetic flux density distribution in the direction of a belt width, corresponding to the distance between a suspended magnet unit and a belt.

For example, in a prototype model, a plate magnet having a length of 45 cm in its longer direction is used as a suspended magnetic separator, with respect to a belt width of 30 cm. If necessary, the suspended magnet may be provided with a vertical micro-motion device, to have a function of moving upward and downward within a range of from 2 cm to 50 cm from the surface of a belt by a millimeter unit. With this configuration, the magnetic separator covers a very low magnetic flux density range of roughly from over 0 gauss to 700 gauss (from over 0 tesla [T] to 0.07 tesla [T]), and can suppress variations in magnetic flux density over a surface of the belt to roughly 10% or less as shown in FIG. 1. In FIG. 1, the vertical axis represents magnetic flux density [tesla] ([T]), and the horizontal axis represents a belt width (a distance from the center) [mm]. FIG. 1 plots magnetic flux density distributions in the direction of the belt width when the distance between the suspended magnet unit and the belt is 0 mm (i.e., the suspended magnet unit is on the belt surface), 25 mm, 50 mm, 75 mm, and 100 mm, respectively. It can be seen that there are almost no variations in the magnetic flux density distributions.

Figure 2:
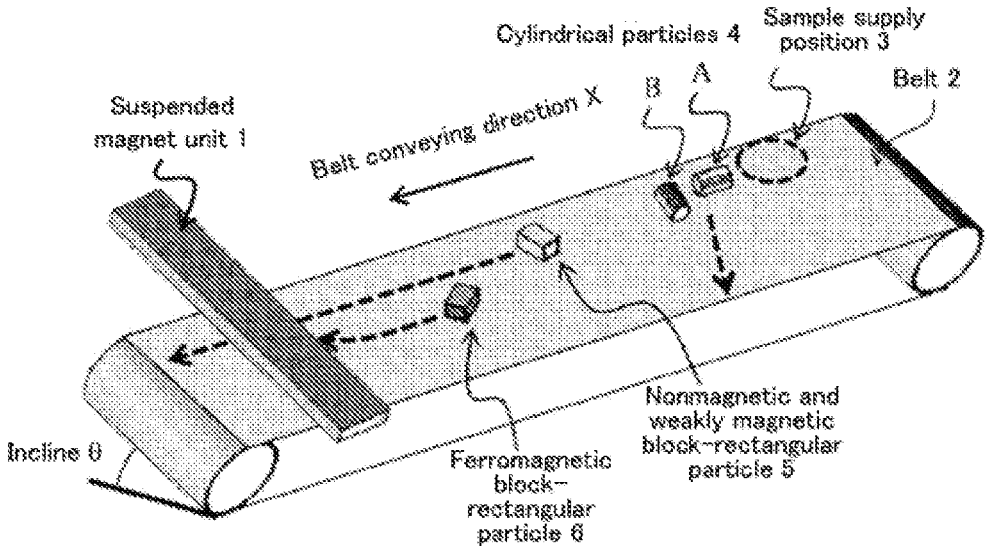
FIG. 2 is a diagram explaining behaviors of particles over an inclined belt when an inclined belt is used.

Furthermore, the present invention incorporates into the weak magnetic force magnetic separator described above, a new feature for promoting shape separation by inclining the belt of the belt conveyor toward a direction that is at a right angle from the moving direction of the belt as shown in FIG. 2, to thereby make the magnetic separator serve also as a shape separator, and enable this apparatus, although being compact, to perform highly precise separation into three components, namely "spherical/cylindrical particles", "ferromagnetic particles", and "remaining particles".

For example, a case of separating electronic elements stripped from waste printed circuit boards into respective kinds will be considered. Electronic elements include flat elements such as ICs and memories, rectangular-parallelepiped elements such as tantalum capacitors, and cylindrical elements such as aluminum electrolytic capacitors. Because there exist almost no spherical particles, elements that are expected to roll down an inclined belt are aluminum electrolytic capacitors.

In FIG. 2, a reference sign 1 denotes a suspended magnet unit, a reference sign 2 denotes a belt, a reference sign 3 denotes a sample supply position, a reference sign 4 denotes cylindrical particles, a reference sign 5 denotes nonmagnetic and weakly magnetic block-rectangular particles, a reference sign 6 denotes ferromagnetic block-rectangular particles, a reference sign X denotes a belt conveying direction, and a reference sign θ denotes incline of a belt surface of the belt 2. As shown in FIG. 2, the inclination is expressed as leftward dangling (or rightward dangling) of the belt surface of the belt 2 from a horizontal surface when seen in the belt conveying direction.

When a cylindrical aluminum electrolytic capacitor is supplied onto a mere inclined belt 2, there are a case when it immediately roll downward, and a case when it does not roll but is conveyed by the conveyor. The former is a case when the cylindrical shape is supplied with its side surface turning to the inclination direction (the cylindrical particle 4 represented by A in FIG. 2). The latter is a case when an end surface of the cylindrical shape turns to the inclination direction (the cylindrical particle 4 represented by B in FIG. 2). In the latter case, unless the cylindrical particle is rolled down the inclined surface before the conveyor arrives at the terminal point, the precision of shape separation becomes poor.

Figure 3:
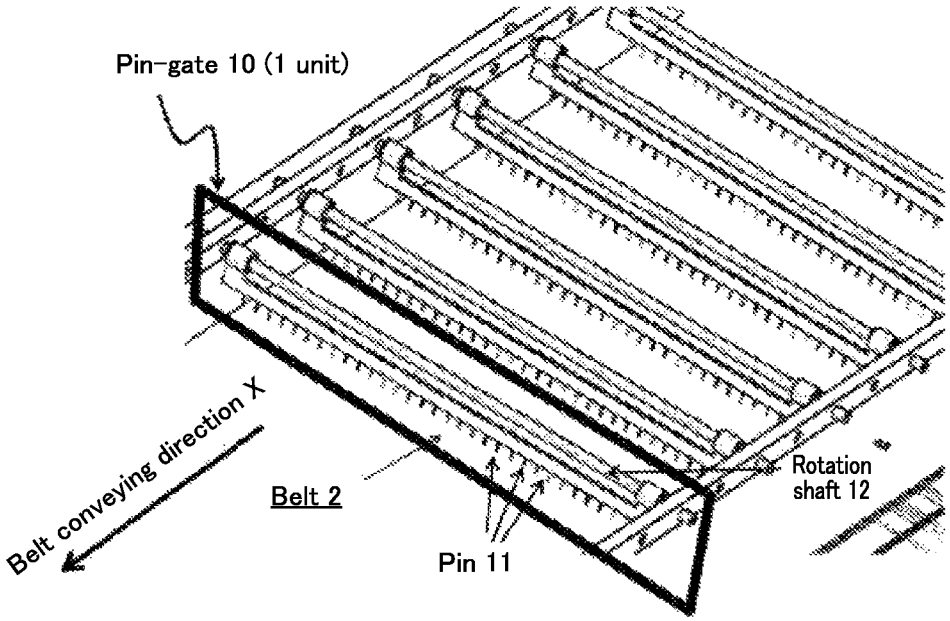
FIG. 3 is a diagram showing an example of a swing pin-gate placed above a belt.

Hence, the present invention sees to it that the particle B of which end surface turns to the inclination direction (i.e., of which side surface turns to the conveying direction) immediately rolls down the inclined surface, by providing the weak magnetic force magnetic separator with a thin pin obstacle above the belt halfway of conveyance by the conveyor, to let the cylindrical particle change postures upon contacting the obstacle and its side surface turn to the inclination direction during the process of changing postures. Here, the pin must be fixed in the apparatus in the form of being suspended from above the belt. Further, in order to ensure a contact with the particle, it is preferable to provide not one pin, but many in the inclination direction. However, if there are too many pins to make the interval between the pins narrow, particles cannot pass through the pins, but accumulate and cause blocking. If the interval between the pins is broad, there will be many particles that go without contacting the pins. Hence, swing pin-gates are employed in order to prevent blocking by accumulation of particles and keep secure contacts of the pins with particles. As shown in FIG. 3, a swing pin-gate is a plate (pin gate 10) that includes multiple pins 11 attached to a rotation shaft 12 rotatable in the forward direction of the belt conveying direction X, and is hung from above the belt 2 like a curtain. When having no contact with a particle, the pin-gate 10 is hung perpendicularly to the belt 2 by gravity. Upon contacting a particle, the pin-gate 10 prompts the particle to change postures, while also swinging about the rotation shaft 12 to the moving direction of the belt 2 due to the move of the particle accompanying the move of the belt 2 to thereby prevent blocking by the particle. The side surface of a particle may not turn to the inclination direction only by making contact once. Therefore, in order to make this sure, it is preferable to provide the pin gates 10 at three or more locations.

The weak magnetic force magnetic separator of the present invention is applicable to a plurality of variously mixed kinds of particles of from 0.1 mm or mainly 1 mm to 80 mm (or preferably 30 mm). One typical application target is electronic elements stripped from waste printed circuit boards. The present inventors have already filed a patent application for "a tantalum capacitor recycling method" of PTL 7, which is a method for extracting only tantalum capacitors at a high concentration from mixed electronic elements through three steps of screening (sieve separation), gas stream separation, and magnetic separation. As a method for removing crystal oscillators that are co-present with tantalum capacitors after gas stream separation, PTL 7 expressly describes magnetic separation with a usually rarely employed weak magnetic force of 240 gauss (0.024 tesla), as a condition for magnetically attracting only crystal oscillators and not magnetically attracting tantalum capacitors irrespective of whether tantalum capacitors have a lead wire or not. The weak magnetic force magnetic separator of the present invention is an apparatus that can not only satisfy this condition, but also recover cylindrical aluminum electrolytic capacitors individually with an inclined belt.

The weak magnetic force magnetic separator of the present invention that realized a uniform, weak magnetic force, and its conveyor were able to realize more highly precise element separation in a tantalum capacitor recovery test, when they were provided with a function as an inclined belt shape separator with swing pin-gates, based on the "tantalum capacitor recycling method" of PTL 7. Specifically, when a mixed element mock sample having a similar particle diameter and specific gravity to those of tantalum capacitors (i.e., extremely difficult to separate) was subjected to a test for removing crystal oscillators and aluminum electrolytic capacitors (which were impurities) co-present with tantalum capacitors, crystal oscillators could be removed with the weak magnetic force magnetic separation function, and aluminum electrolytic capacitors could be removed with the inclined belt separation function. Further, the apparatus of the present invention, although compact, is capable of continuous supply and discharge, can process about 20 kg/h of elements with a conveyor having a length of 1 m, and about 40 kg/h of elements with a conveyor having a length of 2 m, and is very practical.

INDUSTRIAL APPLICABILITY

The present invention has been developed mainly as a weak magnetic force magnetic separator in a recycling industry, but is applicable not only to a recycling industry but also as a weak magnetic force magnetic separator in all technical fields in which separation is performed with a weak magnetic force, such as material control in a manufacturing industry.

REFERENCE SIGNS LIST

1 suspended magnet unit
2 belt
3 sample supply position
4, A, B cylindrical particles
5 nonmagnetic and weakly magnetic block-rectangular particles
6 ferromagnetic block-rectangular particles
10 pin-gate
11 pin
12 rotation shaft
X belt conveying direction
θ incline

The invention claimed is:

1. A weak magnetic force magnetic separator, comprising:

a belt conveyor configured to convey separation target particles; and a suspended magnet unit provided above the belt conveyor at a distance from the belt conveyor, wherein said weak magnetic force magnetic separator, further comprises at least one swing pin-gate above the belt of the belt conveyor, wherein the separation target particles conveyed over the belt are prompted to change postures over the belt upon contacting a pin of the pin-gate, wherein the magnet unit magnetically recovers ferromagnetic bodies and refuses to magnetically recover weakly magnetic bodies by magnetically attracting, with a uniform, weak magnetic force, the separation target particles conveyed over a belt of the belt conveyor, wherein with a length of the magnet unit in its longer direction being greater than a belt width of the belt, and with the magnet unit placed such that its longer direction is aligned with a direction of the belt width and its both ends overhang the belt width, and such that a distance from a surface of the belt is constant across its longer direction, variations in magnetic flux density in the direction of the belt width over the surface of the belt facing the magnet unit are 10% or less within a weak magnetic force range of from over 0 gauss to 700 gauss and wherein the weak magnetic force magnet separator separates the separation target particles based on shapes thereof into those having a shape that rolls down an inclined surface by gravity and those having a shape that does not roll down the inclined surface by gravity, by inclining the belt of the belt conveyor toward a direction that is at a right angle from a moving direction of the belt.

2. A method of separating highly concentrated tantalum capacitor products from separation target particles wherein the separation target particles are obtained from elements stripped and recovered from used printed circuit boards after a step of primary concentration followed by a step of secondary concentration, wherein the step of primary concentration comprises of recovering particles that are in a same dimension range as that of tantalum capacitors from elements stripped and recovered from used printed circuit boards, and wherein the step of secondary concentration comprises recovering separation target particles that are in a same specific gravity range as that of the tantalum capacitors from the particles recovered by the step of primary concentration, said method comprising providing the weak magnetic force magnetic separator according to claim to 1 and obtaining from the separation target particles, particles that are discharged from the belt conveyor without being magnetically recovered, as highly concentrated tantalum capacitor products.

* * * * *